US010408394B2

(12) United States Patent
Bugenske et al.

(10) Patent No.: US 10,408,394 B2
(45) Date of Patent: Sep. 10, 2019

(54) LED RETROFIT LIGHTING APPARATUS FOR A LIGHT FIXTURE

(71) Applicant: GE Lighting Solutions, LLC, East Cleveland, OH (US)

(72) Inventors: Matthew Alan Bugenske, East Cleveland, OH (US); Steve Germain, Lachine (CA); William George Kickel, East Cleveland, OH (US); David Wan Fong, Lachine (CA)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/421,678

(22) Filed: Feb. 1, 2017

(65) Prior Publication Data

US 2018/0216788 A1 Aug. 2, 2018

(51) Int. Cl.

| | |
|---|---|
| ***F21S 8/00*** | (2006.01) |
| ***F21V 19/02*** | (2006.01) |
| ***F21Y 115/10*** | (2016.01) |
| ***F21V 19/00*** | (2006.01) |
| ***F21Y 103/00*** | (2016.01) |
| *F21V 15/015* | (2006.01) |
| *F21V 3/02* | (2006.01) |

(52) U.S. Cl.

CPC ..... *F21S 8/00* (2013.01); *F21V 19/02* (2013.01); *F21V 3/02* (2013.01); *F21V 15/015* (2013.01); *F21V 19/0085* (2013.01); *F21Y 2103/00* (2013.01); *F21Y 2115/10* (2016.08)

(58) Field of Classification Search

CPC . F21K 9/275; F21K 9/272; F21V 3/02; F21V 7/00; F21V 15/015; F21V 17/10; F21V 17/12; F21V 21/14; F21Y 2115/10

USPC ..... 362/220

See application file for complete search history.

(56) References Cited

U.S. PATENT DOCUMENTS

| | | | | |
|---|---|---|---|---|
| 2,350,341 A * | 6/1944 | De Reamer | H01R 33/089 | 362/217.08 |
| 2,965,348 A * | 12/1960 | Gerstel | F21V 21/04 | 108/25 |
| 3,609,338 A * | 9/1971 | Kripp | F21V 21/04 | 362/311.06 |
| 3,818,418 A * | 6/1974 | Detch | H01R 33/02 | 439/232 |
| 4,191,989 A * | 3/1980 | Page | F21S 8/02 | 362/220 |

(Continued)

FOREIGN PATENT DOCUMENTS

EP 2 149 747 A1 2/2010

*Primary Examiner* — Tsion Tumebo

(74) *Attorney, Agent, or Firm* — Buckley, Maschoff & Talwalkar, LLC

(57) ABSTRACT

Provided is a light-emitting diode retrofit lighting apparatus for an existing light fixture that includes one or more lamp holders. The apparatus includes a base portion to be mounted to the light fixture, a light-emitting diode mounting part connected with the base portion and configured to receive a light-emitting diode lighting source, an adjustment portion to be received within the base portion and configured to adjust the apparatus in a vertical direction, and at least one sliding mechanism configured to be mounted on and slide along the adjustment portion to adjust the one or more lamp holders in a horizontal direction.

18 Claims, 12 Drawing Sheets

(56) References Cited

U.S. PATENT DOCUMENTS 4,772,216 A * 9/1988 Szymanek ..... H01R 33/0872 362/217.08
4,811,177 A * 3/1989 Lauckhardt ..... F21S 8/02 362/220
5,013,253 A * 5/1991 Aiello ..... F21V 19/008 439/235
5,368,495 A * 11/1994 Raby, Sr. ..... F21V 19/009 362/217.09
6,102,550 A * 8/2000 Edwards, Jr. ..... F21S 8/02 362/217.05
6,439,741 B1 * 8/2002 Diaz ..... F21S 8/04 362/217.16
6,632,001 B2 * 10/2003 Chen ..... A47B 61/003 362/127
6,945,671 B1 * 9/2005 Swarens ..... F21V 14/02 362/220
6,964,502 B1 * 11/2005 Verfuerth ..... F21S 8/04 362/217.09
7,018,072 B2 * 3/2006 Mier-Langner ..... F21V 19/0085 362/217.07
D543,305 S * 5/2007 Wang ..... D26/60
7,306,359 B2 * 12/2007 Harwood ..... F21S 2/005 362/382
7,311,434 B2 * 12/2007 Pryor ..... F21V 21/35 362/147
7,357,541 B2 * 4/2008 Gamache ..... F21S 8/02 174/58
7,604,379 B2 * 10/2009 Stenback ..... F21V 15/01 362/218
8,092,041 B2 * 1/2012 Fowler, Jr. ..... F21S 8/02 362/225
8,123,540 B2 * 2/2012 Galluccio ..... H01R 33/08 439/241
8,523,381 B1 * 9/2013 Clements ..... F21V 31/005 362/147
8,876,323 B2 * 11/2014 Khanampornpan ..... H01R 13/6273 362/217.17
9,182,107 B2 11/2015 Ekey et al.
9,341,360 B2 * 5/2016 Khanampornpan ..... H01R 33/0881
2005/0073838 A1 * 4/2005 Haugaard ..... F21S 8/06 362/225
2010/0265700 A1 * 10/2010 Galluccio ..... F21V 19/008 362/217.13
2013/0051008 A1 * 2/2013 Shew ..... H02J 9/065 362/235
2014/0078731 A1 3/2014 Harruff
2014/0126194 A1 * 5/2014 Matsuura ..... F21S 8/031 362/217.05
2014/0198481 A1 * 7/2014 Kim ..... F21S 8/026 362/95
2015/0204522 A1 * 7/2015 Baumeister ..... F21K 9/27 362/217.16
2015/0345751 A1 12/2015 Oksengendler et al.
2016/0153641 A1 * 6/2016 Fang ..... F21S 8/026 362/260

* cited by examiner

LED RETROFIT LIGHTING APPARATUS FOR A LIGHT FIXTURE

FIELD

The present invention relates generally to a light-emitting diode (LED) retrofit lighting apparatus for existing light fixtures. In particular, the present invention relates to an LED retrofit lighting relating to non-tubular LED light sources.

BACKGROUND

LED lighting continues to grow in popularity. It also has a greater lifespan and better electrical efficiency than fluorescent lighting. Accordingly, in many instances, it is desirable to replace the existing fluorescent lighting fixtures with LED lighting apparatuses.

One current replacement process involves switching the fluorescent tubes for LED tubes. However, the LED tubes have limited performance capabilities. Another replacement process involves completely removing and replacing the fluorescent light fixtures with new LED lighting apparatuses.

There are several problems associated with the above processes, including decreased lighting performance and undesirable costs associated with replacement of the fluorescent lighting fixtures.

BRIEF SUMMARY OF THE EMBODIMENTS

Given the aforementioned deficiencies, a need exists for an LED retrofit lighting methods and systems for existing lamp holders, to easily convert the existing lamp holders to LED lighting systems.

Under certain circumstances, embodiments of the present invention provide a light-emitting diode retrofit lighting apparatus for an existing light fixture that includes one or more lamp holders. The apparatus includes a base portion to be mounted to the light fixture, a light-emitting diode mounting part connected with the base portion and configured to receive a light-emitting diode lighting source, an adjustment portion to be received within the base portion and configured to adjust the apparatus in a vertical direction, and at least one sliding mechanism configured to be mounted on and slide along the adjustment portion to adjust the one or more lamp holders in a horizontal direction.

Another embodiment of the present invention also includes a method for attaching a light-emitting diode retrofit lighting apparatus to an existing light fixture that includes one or more lamp holders is provided.

According to yet another embodiment, a light-emitting diode retrofit lighting apparatus to be attached to an existing light fixture including a lamp holder is provided. The apparatus includes a base portion including a handle including hook portions, an adjustment portion including slots to receive the hook portions of the base portion therein for height adjustment of the lamp holder in a vertical direction, a receiving portion connected to the base portion for receiving the adjustment portion therein, and a mounting part including openings for receiving a connector therein, to mount the apparatus to the existing light fixture or lamp holder.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

Figure 1:
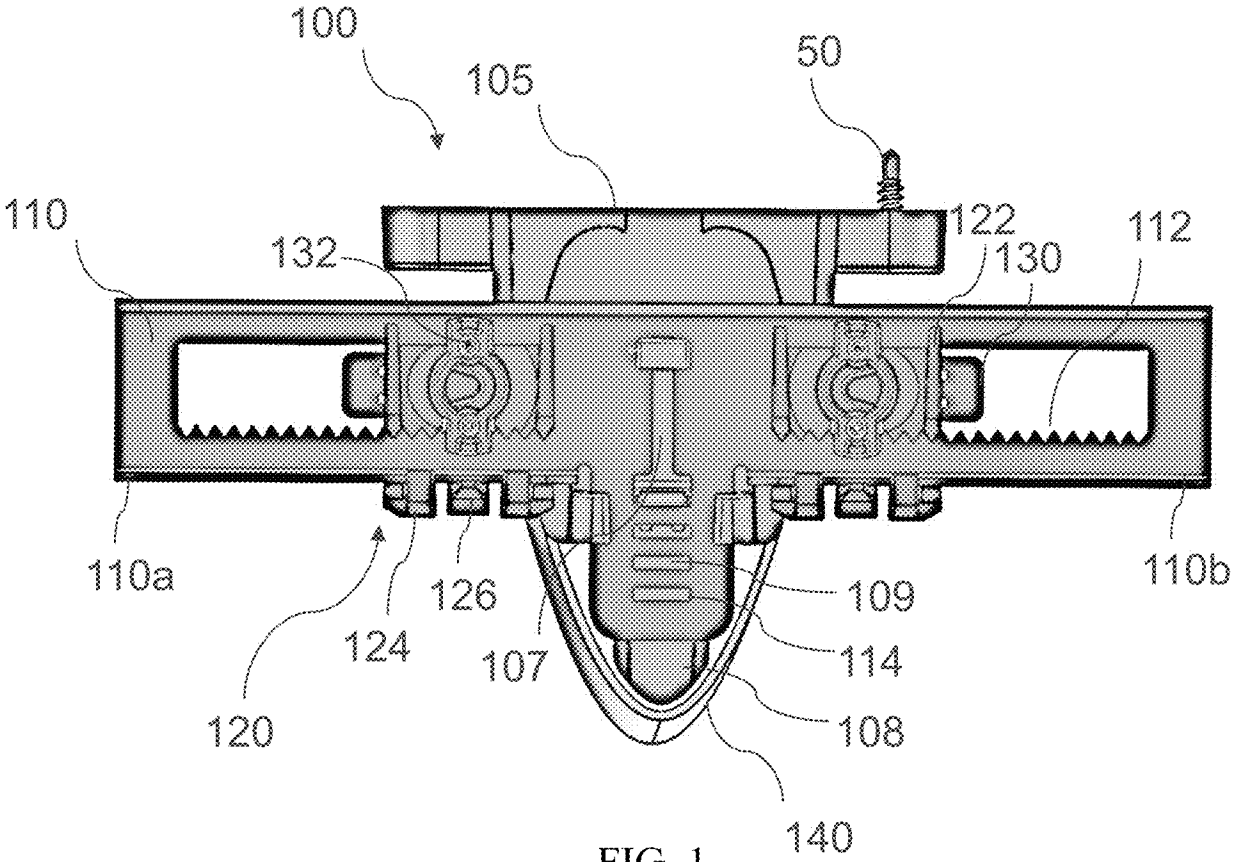
FIG. 1 is a back view illustrating an LED retrofit lighting apparatus to be mounted to an existing light fixture and one or more lamp holders, that can be implemented within one or more embodiments of the present invention.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components.

In other instances, well-known components, apparatuses, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

As noted above, the embodiments provide an LED retrofit lighting apparatus that can be implemented within existing light fixture and one or more lamp holders to convert a fluorescent lighting system to an LED lighting system with ease. The LED retrofit lighting apparatus includes a sliding mechanism to enable horizontal and vertical height and width adjustment of the apparatus for desired lighting position and lighting direction. The LED retrofit lighting apparatus can connect to the existing electrical connection or an external electrical connection for the LED lighting source to be added.

FIG. 1 is a schematic view illustrating the LED retrofit lighting apparatus 100 that can be implemented within one or more embodiments of the present invention. The LED retrofit lighting apparatus includes a base portion 105, an adjustment portion 110, and at least one sliding mechanism 120.

The base portion 105 can be mounted to an existing light fixture (as depicted in FIG. 5) by an optional connector (e.g., a screw) 50. The base portion 105 includes a mounting portion 107, a handle 108, including a plurality of hook portions 109 for receiving the adjustment portion 110. The base portion 105 also includes a holding mechanism 111 (as depicted in FIG. 4A) for receiving and fixedly securing the adjustment portion 110 thereon. According to one or more embodiments, the adjustment portion 110 is connected to the handle 108.

The adjustment portion 110 is desirably an elongated part including a plurality of teeth portions 112, on opposite side ends 110*a* and 110*b*. The teeth portions 112 are for receiving the at least one sliding mechanism 120, and performing width adjustments of the LED lighting source to be added.

The adjustment portion 110 further includes a plurality of slots 114 to be received in the hook portions 109 of the base portion 105, for height adjustment of the LED lighting source. Three hook portions 109 and three slots 114 are shown for illustration purposes only. The present invention, however, is not limited to any particular number of hook portions 109 or slots 114 and can be varied as desired.

Also shown in FIG. 1, the LED retrofit lighting apparatus 100 further includes a pair of sliding mechanisms 120, including rib portions 122, locking hook portions 124 and a spring part 126. The sliding mechanism 120 is configured for attaching to the adjustment portion 110, and to be adjusted horizontally along the teeth portions 112 of the adjustment portion 110. Details regarding locking and unlocking of the sliding mechanism 120 will be discussed below, with reference to FIGS. 3A, 3B, 4A and 4B.

Figure 7:
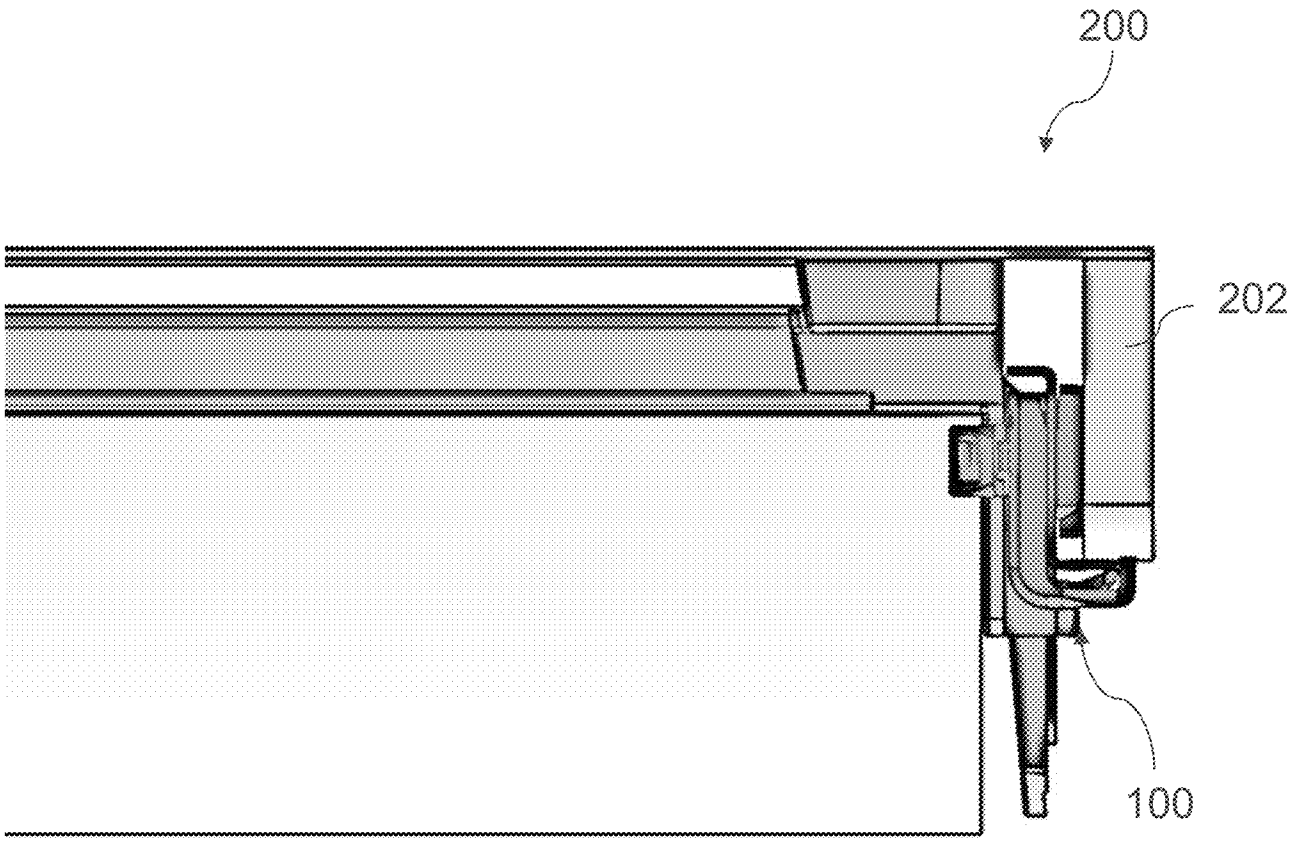
FIG. 7 is a schematic view illustrating a connection between the LED retrofit lighting apparatus of FIG. 1 and existing light fixture and one or more lamp holders that can be implemented within one or more other embodiments of the present invention.

The LED retrofit lighting apparatus 100 further includes rotating mounting parts 130 which are attached to the sliding mechanisms 120, and are rotatable to mount to the existing lamp holder. The rotating mounting parts 130 includes pins 132 to be inserted into the existing lamp holder, as shown in FIG. 7, discussed below.

A lens 140 is attachable to a lower surface of the base portion 105 to reflect light from the LED light source to be mounted within the LED retrofit lighting apparatus 100.

Figure 2:
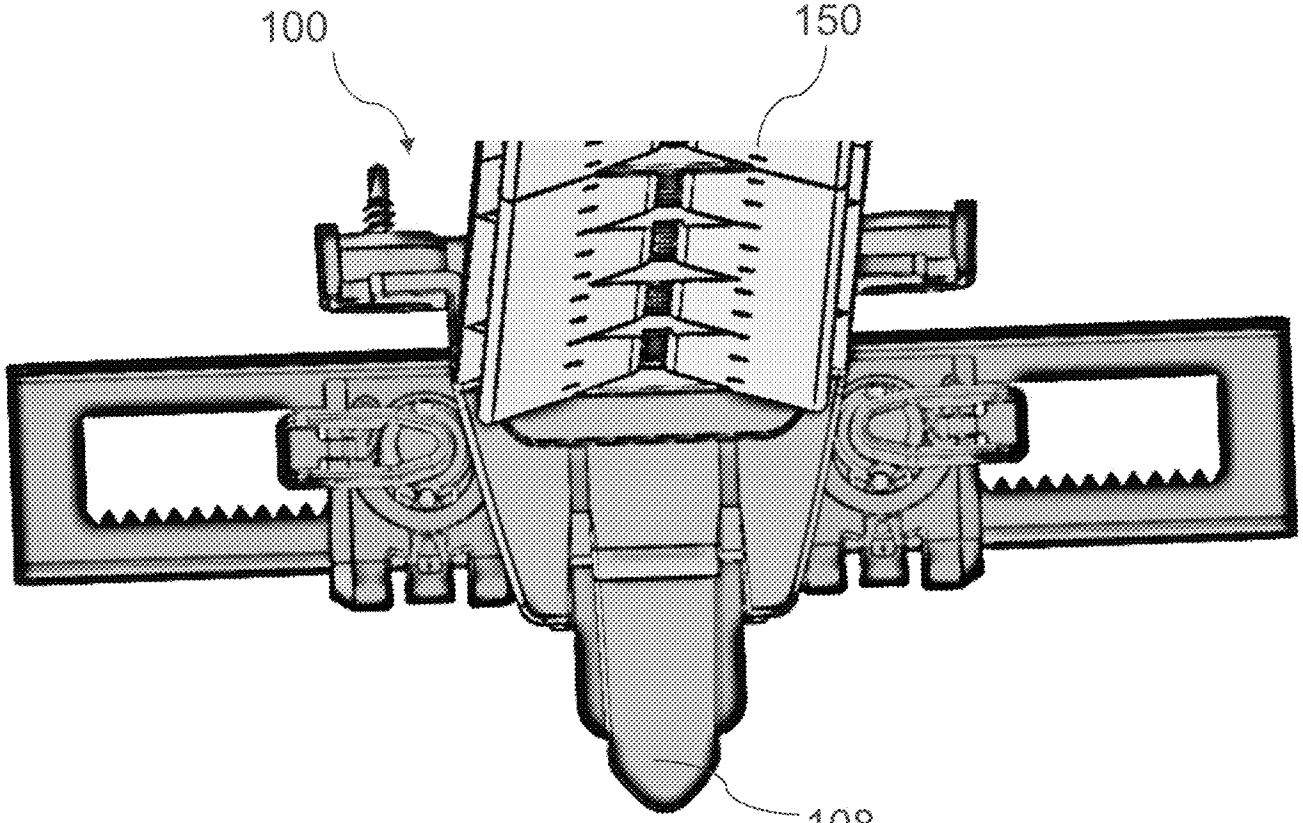
FIG. 2 is a front view illustrating the LED retrofit lighting apparatus of FIG. 1 that can be implemented within one or more embodiments of the present invention.

FIG. 2 is a front view of the LED retrofit lighting apparatus 100 according to the embodiments. As shown in FIG. 2, the LED retrofit lighting apparatus 100 includes an LED mounting part 150 for mounting the non-tubular (e.g., non-cylindrical) LED light source(s) thereon.

Figure 3A:
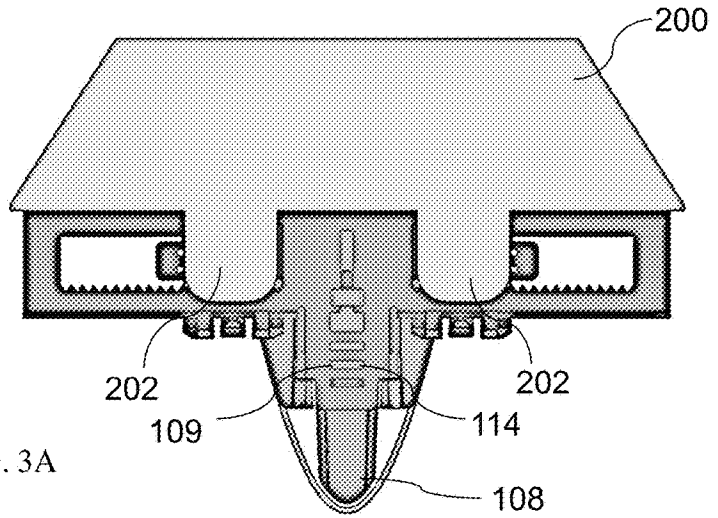
FIGS. 3A and 3B are schematics illustrating the vertical adjustment of the apparatus 100 by adjusting the adjustment portion 110 in a vertical direction using the handle 108. These embodiments illustrate the vertical adjustment of the apparatus 100 depending upon the height of the existing lamp holders 202
Figure 3B:
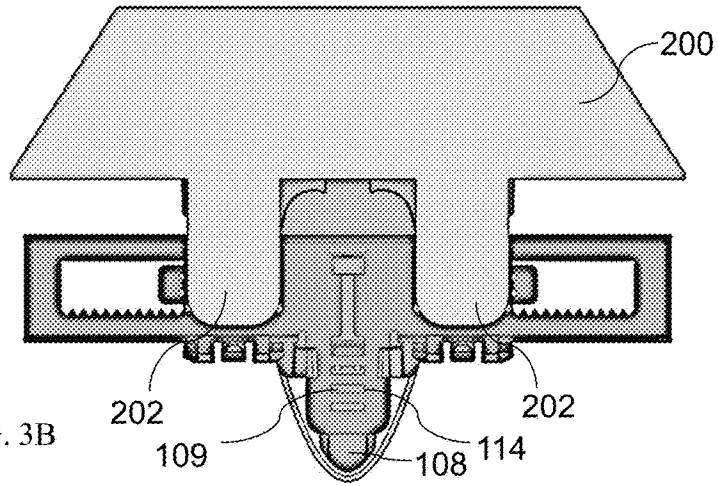

The handle 108 is used to hook/unhook the hook portions 109 within the slots 105 114 (shown in FIG. 1). This hooking/unhooking adjusts the height of the LED mounting part 150 to adjust the height of the LED lighting source(s) mounted therein. FIGS. 3A and 3B are schematics illustrating the vertical adjustment of the apparatus 100 by adjusting the adjustment portion 110 in a vertical direction using the handle 108. These embodiments illustrate the vertical adjustment of the apparatus 100 depending upon the height of the existing lamp holders 202. As shown in FIG. 3A, the lamp holders 202 are short therefore the adjustment portion 110 is maintained in a top position along the handle 108 via the hooks 109 inserted into the slots 114 as shown. Alternatively, as shown in FIG. 3B, the lamp holders 202 are taller, therefore, the adjustment portion 110 is adjusted vertically along the handle 108 and locked into position via insertion of a respective hook 109 into the appropriate slot 114.

Figure 4B:
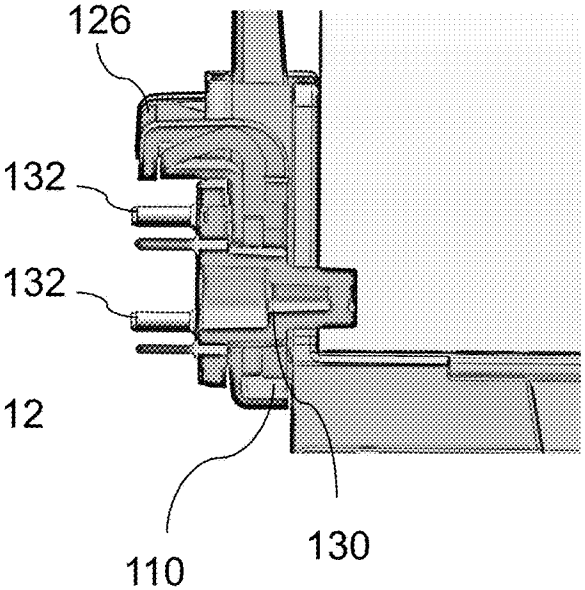
FIGS. 4A, 4B, 4C are schematic views and a sectional view, respectively, of a sliding mechanism of the LED retrofit lighting apparatus of FIG. 1 in a locked position, respectively that can be implemented within one or more other embodiments of the present invention.
Figure 4A:
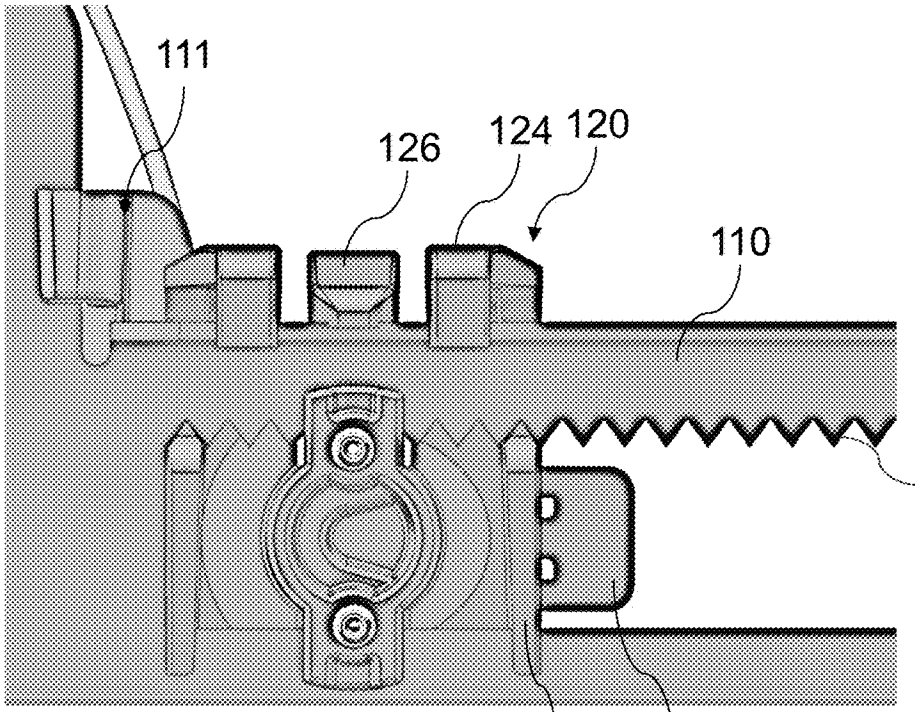
Figure 4C:
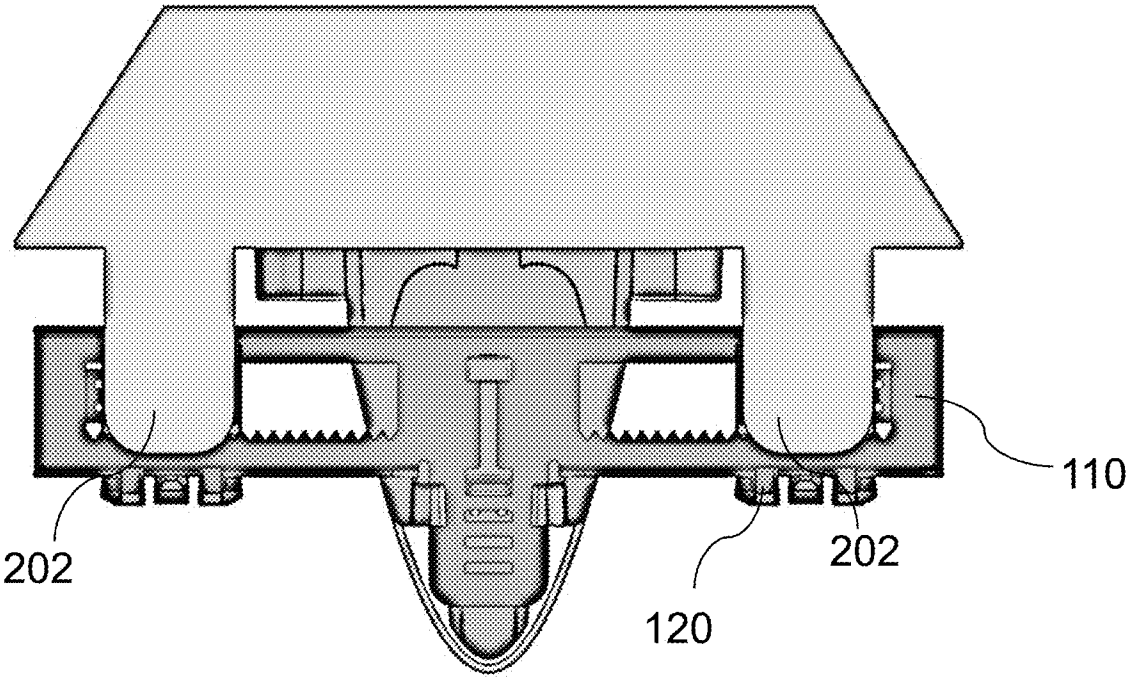

FIGS. 4A, 4B and 4C are schematics illustrating details of a sliding mechanism 120 in a locked position along the teeth portion 112 of the adjustment portion 110. As shown in FIG. 4A, the locking hook portions 124, the spring part 126, and the ribs 122 are locked into place along the adjustment portion 110. The ribs 122 are engaged with the teeth portions 112 to maintain a fixed position of the sliding mechanism 120 on the adjustment portion 110. Further, as shown in FIG. 4B, the spring part 126 is in an uncompressed state to facilitate locking of the sliding mechanism 120 onto the adjustment portion 110. As shown in FIG. 4C, the sliding mechanisms 120 are locked into place upon adjusting the sliding mechanisms 120 along the adjustment portion 100, in opposite horizontal directions to be spaced a predetermined distance apart depending how spaced apart the lamp holders 202 are from each other.

Figure 5B:
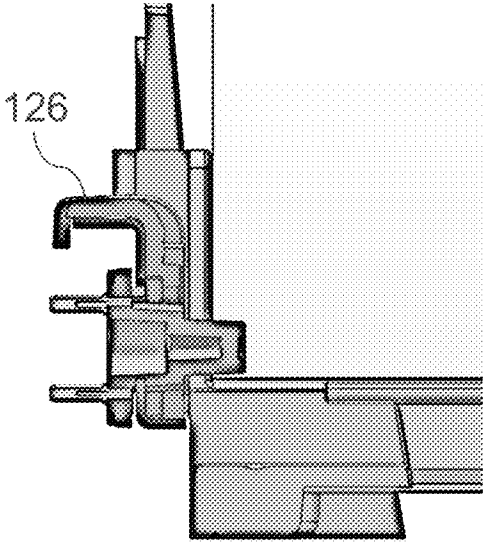
FIGS. 5A and 5B are a schematic view and a sectional view of a sliding mechanism of the LED retrofit lighting apparatus of FIG. 1 in an unlocked position, respectively that can be implemented within one or more other embodiments of the present invention.
Figure 5A:
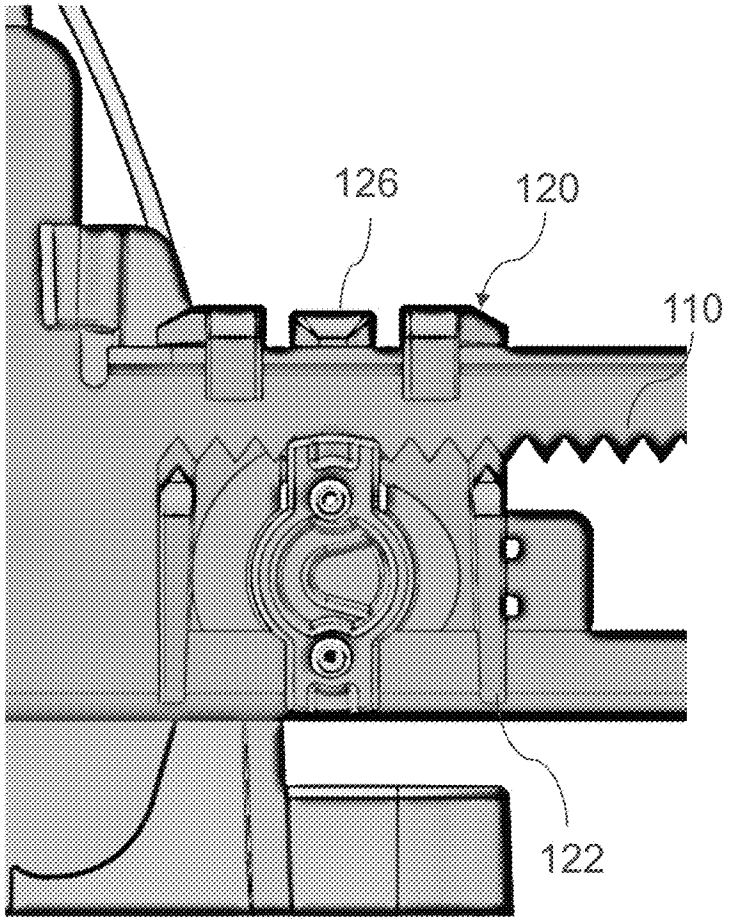

FIGS. 5A and 5B are schematics illustrating details of the sliding mechanism 120 in an unlocked position to be adjusted along the adjustment portion 110. As shown in FIGS. 5A and 5B, the spring part 126 is compressed by pushing the sliding mechanism 120 in a downward direction such that the sliding mechanism 120 is released and the rib 122 is disengaged, thereby the sliding mechanism 120 can freely slide along with adjustment portion 110.

Figure 6:
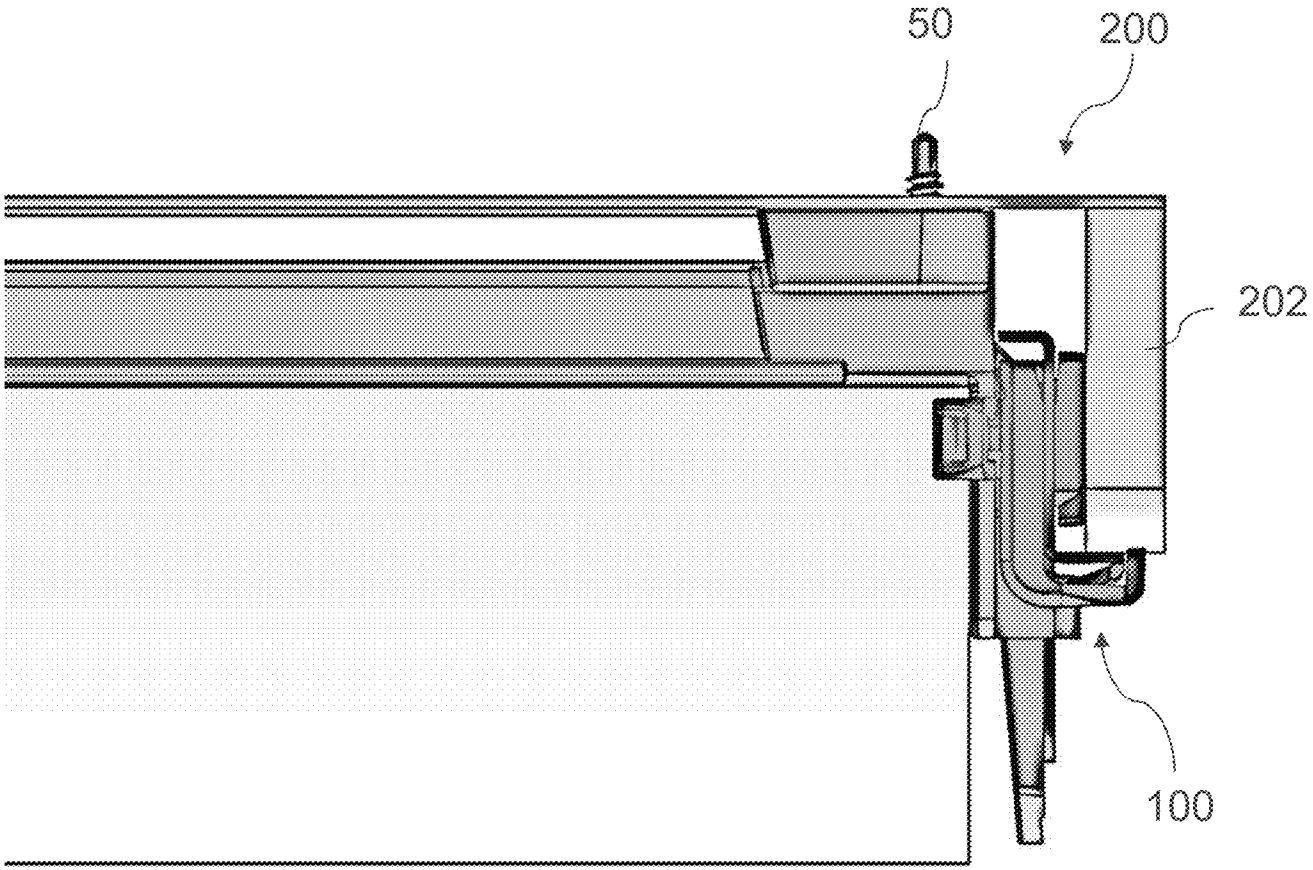
FIG. 6 is a schematic view illustrating a connection between the LED retrofit lighting apparatus of FIG. 1 and an existing light fixture and one or more lamp holders that can be implemented within one or more embodiments of the present invention.
Figure 8:
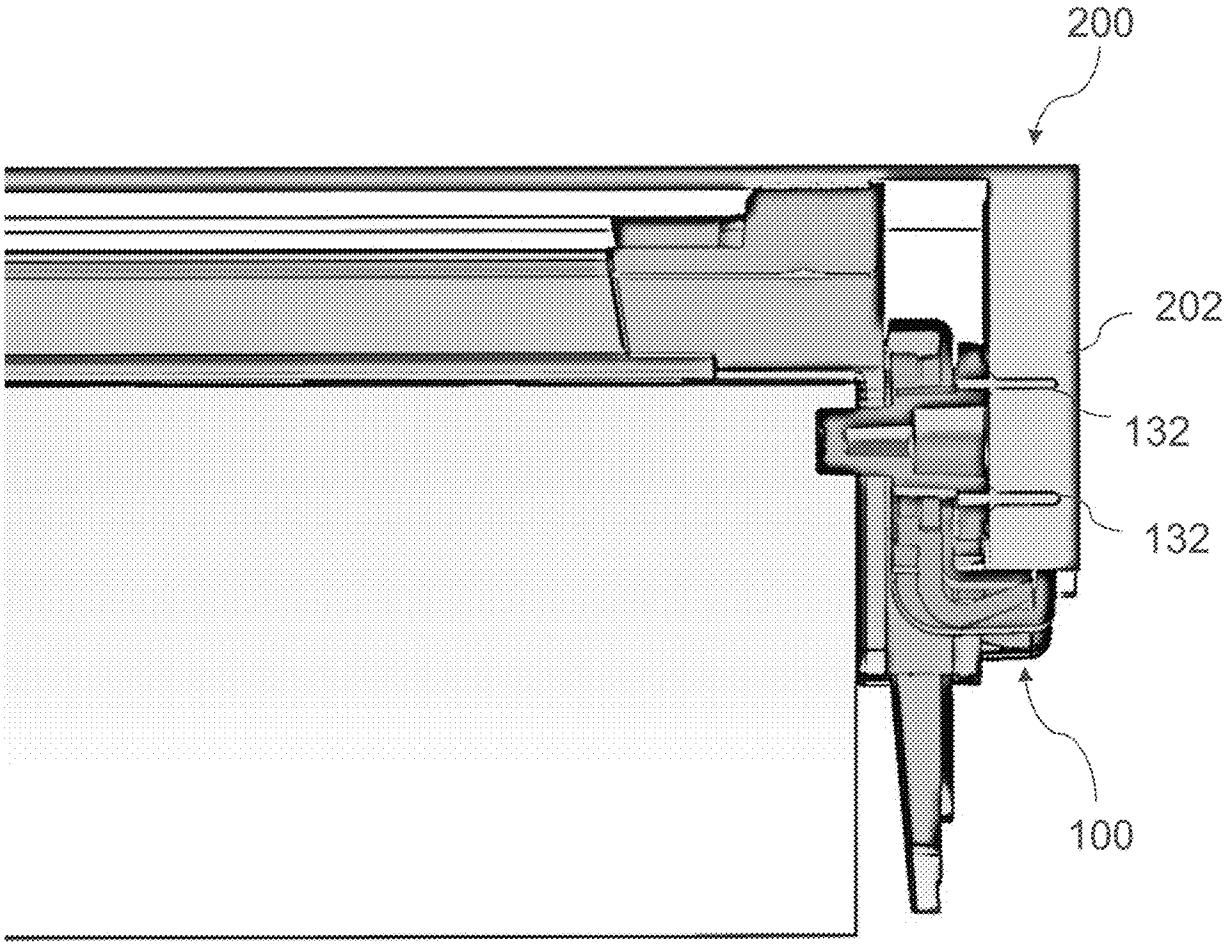
FIG. 8 is a partial sectional view of the connection shown in FIG. 7 that can be implemented within one or more other embodiments of the present invention.

FIGS. 6, 7 and 8 are schematics illustrating the connection between the LED retrofit lighting apparatus 100 and an existing lamp holder/fixture 200, 202 that can be implemented within one or more embodiments of the present invention.

As shown in FIG. 6, the LED retrofit lighting apparatus 100 is connected with the existing light fixture 200 at a top surface thereof via the connector 50 (e.g., a screw). The existing light fixture 200 includes one or more lamp holders 202. In this embodiment, the existing electrical connection of the light fixture 200 is not employed. Instead, an external electrical connection can be installed to connect to the existing light fixture 200 for supplying electrical power to the LED light source(s) to be mounted.

Alternatively, as shown in FIGS. 7 and 8, according to another embodiment, the LED retrofit lighting apparatus 100 can be connected to the existing lamp holder 202 of the light fixture 200 by pins 132 of the rotating part 130, as shown in FIG. 7. As shown in FIG. 8, the pins 132 are inserted directly into the lamp holder 202, and the rotating part 130 can be rotated to lock the pins 132 into place.

Figure 9B:
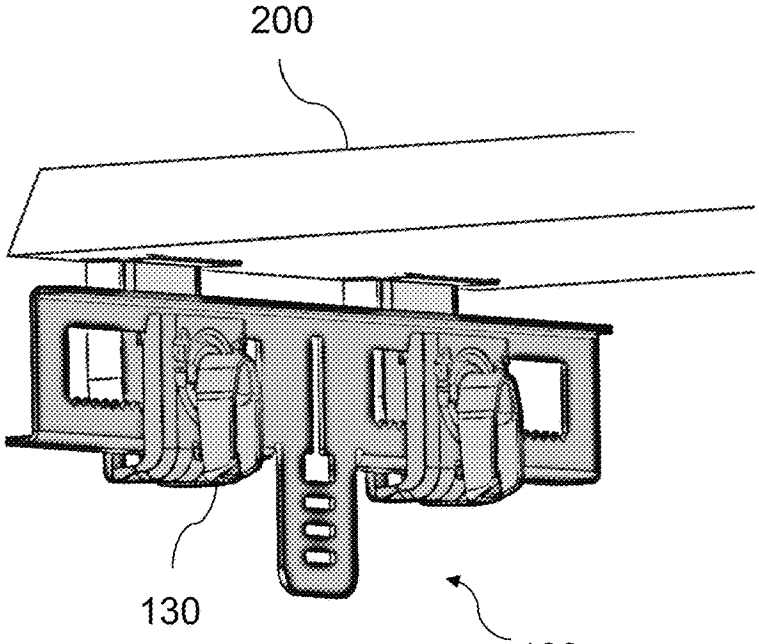
FIGS. 9A and 9B are schematic views illustrating the details of operation of the rotating part and the pins of the retrofit lighting apparatus of FIG. 1, which can be implemented within one or more embodiments of the present invention
Figure 9A:
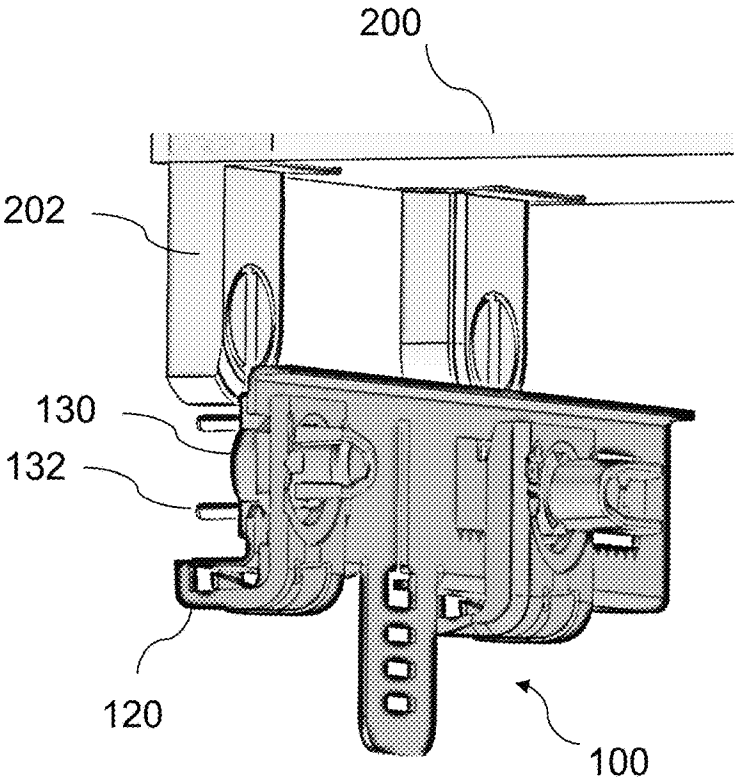

FIGS. 9A and 9B are schematic views illustrating the details of operation of the rotating part 130 and the pins 132 thereof, which can be implemented within one or more embodiments of the present invention. As shown in FIG. 9A, the existing light fixture 200 and the lamp holder 202 are connected to the apparatus 100 via the pins 132. The rotating parts 130 including grooves that function in concert with the sliding mechanism 120 to hold the pins 132 vertically, into place upon snap-fitting into the rotating parts 130 to be inserted into the lamp holder(s) 202. As further shown in FIG. 9B, the rotating parts 130 are each rotated approximately 90° to turn the pins in a horizontal orientation and to lock the pins 132 into the lamp holder(s) 202. Therefore, the lighting apparatus 100 easily connects to the existing light fixture 200 and lamp holder 202.

Figure 10A:
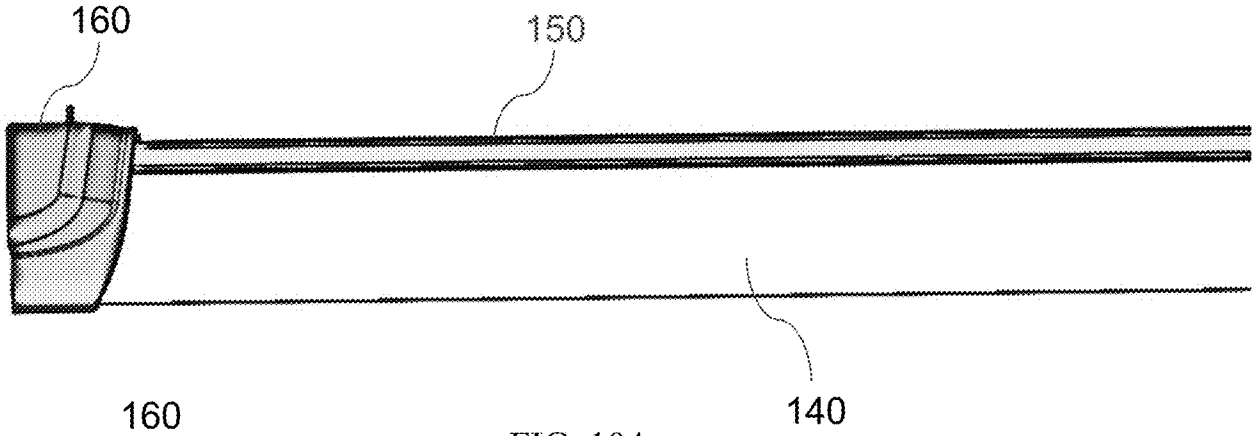
FIGS. 10A and 10B are a top view and side view illustrating a cover of the LED retrofit lighting apparatus of FIG. 1, respectively that can be implemented within one or more embodiments of the present invention.
Figure 10B:
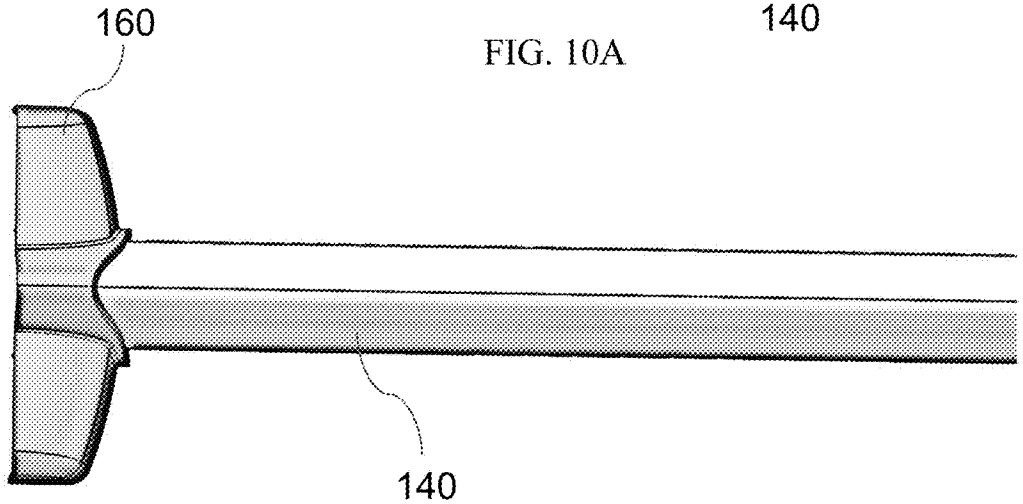

FIGS. 10A and 10B are schematics of a cover 160 which covers and creates an outer appearance of the LED retrofit lighting apparatus 100 depicted in FIGS. 1 through 9B. The cover 160 attaches to the LED mounting part 150 and the lens 140 to complete the outer appearance of the LED retrofit lighting apparatus 100.

Figure 11:
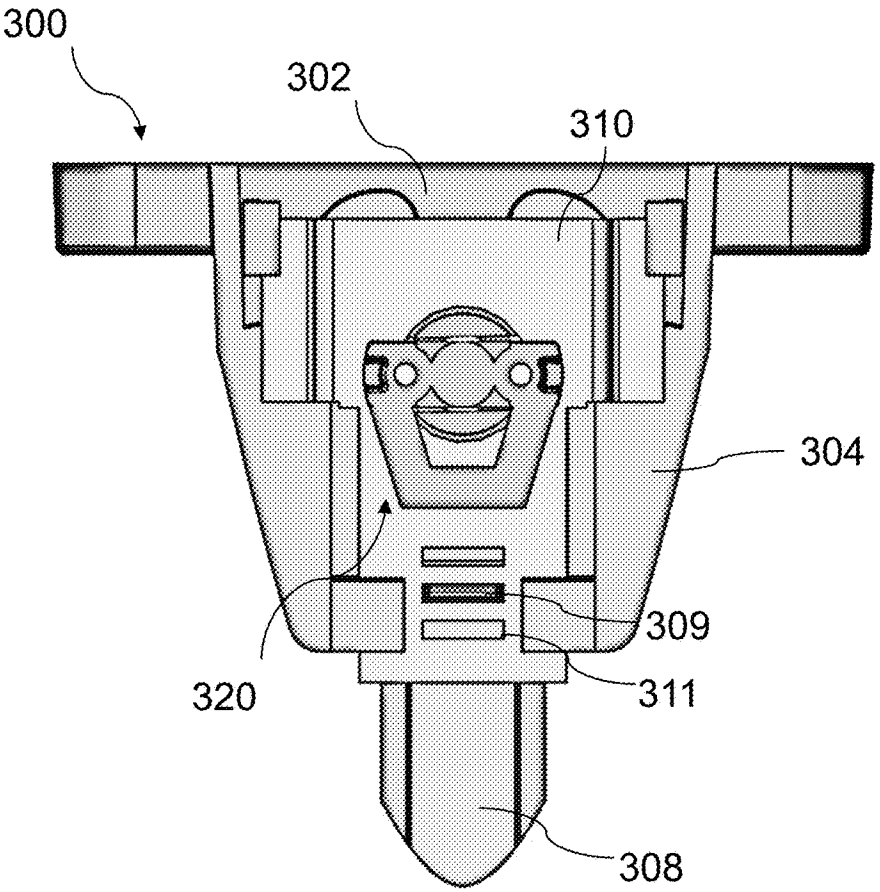
FIG. 11 is a schematic view illustrating an LED retrofit lighting apparatus that can be implemented within one or more other embodiments of the present invention.

The present invention is not limited to the LED retrofit lighting apparatus 100 as shown in FIGS. 1 through 10B, and can therefore be varied as desired to accommodate different types of existing lamp holders/fixtures. FIG. 11 is a schematic view illustrating an LED retrofit lighting apparatus 300 according to one or more other embodiments of the present invention.

As shown in FIG. 11, the LED retrofit lighting apparatus 300 includes a base portion 302, a receiving portion 304. The apparatus 300 also includes a handle 308, including hook portions 309, an adjustment portion 310 including slots 311, and a mounting part 320. The mounting part 320 includes openings for receiving pins or other connectors therein, to mount the LED retrofit lighting apparatus 300 to a light fixture or lamp holder. The electrical connections for the apparatus 300 shown is carried out through connecting using quick push-in connectors. The end cap cover (e.g., 160 as depicted in FIGS. 10A and 10B) serves to "hide" the connectors. There are primarily three wires including a positive, negative and optional a ground connection.

As shown in FIG. 11, the receiving portion 304 is connected with the base portion 302, and receives the adjustment portion 310 therein. The handle 308 is used to hook/unhook the hook portions 309 within the slots 311 of the adjustment portion 310. The apparatus 300 is used when there is only one lamp holder and a single lighting (e.g., fluorescent) tube is being replaced.

Embodiments of the present invention provide an LED retrofit lighting apparatus that can be implemented within existing lamp holders to reduce installation costs of replacing an existing lamp holder and allows different light engine and optic combinations that can be used within the existing lamp holder and minimize the amount of re-wiring necessary for complete replacement of an existing lamp holder.

This written description uses examples to disclose the invention including the best mode, and also to enable any person skilled in the art to practice the invention, including making and using any devices or apparatuses and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A light-emitting diode retrofit lighting apparatus for an existing light fixture comprising more than one lamp holders, the apparatus comprising:

a base portion to be mounted to the light fixture;

a light-emitting diode mounting part connected with the base portion and including LED lighting sources mounted thereon;

an adjustment portion secured to the base portion and configured to adjust the apparatus in a vertical direction;

at least one sliding mechanism mounted on and configured to slide along the adjustment portion to adjust the apparatus in a horizontal direction relative to the more than one lamp holders;

the at least one sliding mechanism is received within the adjustment portion, and configured to perform width adjustment relative to the more than one lamp holders;

the at least one sliding mechanism including:

a plurality of rib portions configured to engage with teeth portions of the adjustment portion;

a plurality of locking hook portions to overlap and hook to side surfaces of the adjustment portion to secure the at least one sliding mechanism to the adjustment portion; and a spring part configured to be compressed and uncompressed to adjust the at least one sliding mechanism horizontally along the teeth portions of the adjustment portion based on a compression state thereof.

2. The light-emitting diode retrofit lighting apparatus of claim 1, wherein the base portion comprises:

a mounting portion configured to mount the adjustment portion thereon;

a holding mechanism configured to receive and fixedly secure the adjustment portion thereon; and a handle comprising a plurality of hook portions and configured to perform height adjustment in the vertical direction.

3. The light-emitting diode retrofit lighting apparatus of claim 2, wherein the adjustment portion is an elongated part comprises:

a plurality of the teeth portions on opposite side ends; and a plurality of slots configured to receive the hook portions of the base portion via the handle, for performing the height adjustment.

4. The light-emitting diode retrofit lighting apparatus of claim 1, further comprising:

at least one rotating mounting part corresponding to the at least one sliding mechanism, and configured to be rotatably mounted to the existing lamp holder.

5. The light-emitting diode retrofit lighting apparatus of claim 4, wherein the at least one rotating mounting part comprises a plurality of pins configured to be inserted into the existing lamp holder.

6. The light-emitting diode retrofit lighting apparatus of claim 4, wherein the apparatus is connected with the existing light fixture by a connector on a top surface of the base portion.

7. The light-emitting diode retrofit lighting apparatus of claim 4, further comprising a lens attachable to a lower surface of the base portion and configured to reflect light from the light-emitting diode light source to be mounted within the apparatus.

8. The light-emitting diode retrofit lighting apparatus of claim 4, wherein the locking hook portions, the spring part and the rib portions are locked into place along the adjustment portion by engaging the rib portions with the teeth portions to maintain a fixed position of the sliding mechanism on the adjustment portion.

9. The light-emitting diode retrofit lighting apparatus of claim 8, wherein the spring part is in an uncompressed state to facilitate locking of the sliding mechanism onto the adjustment portion.

10. The light-emitting diode retrofit lighting apparatus of claim 8, wherein the spring part is compressed by pushing the sliding mechanism in a downward direction such that the sliding mechanism is released and the rib portions are disengaged to thereby allow the sliding mechanism to freely slide along with adjustment portion.

11. The light-emitting diode retrofit lighting apparatus of claim 1, wherein an electrical connection of the existing light fixture is used to supply electrical power to the light-emitting diode light sources.

12. The light-emitting diode retrofit lighting apparatus of claim 1, wherein an external electrical connection from the existing light fixture is used to supply electrical power to the light-emitting diode light source.

13. The light-emitting diode retrofit lighting apparatus of claim 5, wherein the pins are inserted directly into the lamp holders, and the rotating part is configured to be rotated to lock the pins into place.

14. The light-emitting diode retrofit lighting apparatus of claim 7, further comprising a cover configured to cover the light-emitting diode retrofit lighting apparatus, and to attach to the light-emitting diode mounting part and the lens to complete the outer appearance of the light-emitting diode retrofit lighting apparatus.

15. A method for attaching a light-emitting diode retrofit lighting apparatus to an existing light fixture comprising more than one lamp holders, method comprising:

mounting a base portion to the light fixture;

connecting a light-emitting diode mounting part with the base portion, the mounting part including one or more light-emitting diode lighting sources mounted thereon;

securing an adjustment portion to the base portion, to adjust the apparatus in a vertical direction;

mounting at least one sliding mechanism to slide along the adjustment portion for adjusting the light-emitting diode retrofit lighting apparatus in a horizontal direction relative to the more than one lamp holders receiving the at least one sliding mechanism within the adjustment portion to perform width adjustment relative to the more than one lamp holders;

engaging a plurality of rib portions of the at least one sliding mechanism with teeth portions of the adjustment portion;

securing the at least one sliding mechanism to the adjustment portion by overlapping and hooking a plurality of locking hook portions of the at least one sliding mechanism to side surfaces of the adjustment portion; and adjusting the at least one sliding mechanism horizontally along the teeth portions of the adjustment portion by compressing and uncompressing a spring part of the at least one sliding mechanism.

16. The method of claim 15, further comprising:

performing, via a handle, height adjustment in the vertical direction.

17. The method of claim 16, further comprising:

receiving hook portions of the base portion within a plurality of slots of the adjustment portion to perform the height adjustment.

18. A light-emitting diode retrofit lighting apparatus for an existing light fixture comprising more than one lamp holders, the apparatus comprising:

a base portion to be mounted to the light fixture;

a light-emitting diode mounting part connected with the base portion and including LED lighting sources mounted thereon;

an adjustment portion secured to the base portion and configured to adjust the apparatus in a vertical direction; and at least one sliding mechanism mounted on and configured to slide along the adjustment portion to adjust the apparatus in a horizontal direction;

wherein:

the base portion comprises:

a mounting portion configured to mount the adjustment portion thereon;

a holding mechanism configured to receive and fixedly secure the adjustment portion thereon; and a handle comprising a plurality of hook portions and configured to perform height adjustment in the vertical direction; and wherein:

the adjustment portion is an elongated part comprising:

a plurality of teeth portions on opposite side ends; and a plurality of slots configured to receive the hook portions of the base portion via the handle, for performing the height adjustment; and wherein:

the at least one sliding mechanism is received within the adjustment portion, and configured to perform width adjustment relative to the more than one lamp holders, wherein the at least one sliding mechanism comprises:

a plurality of rib portions configured to engage with the teeth portions of the adjustment portion;

a plurality of locking hook portions to overlap and hook to side surfaces of the adjustment portion to secure the at least one sliding mechanism to the adjustment portion; and a spring part configured to be compressed and uncompressed to adjust the at least one sliding mechanism horizontally along the teeth portions of the adjustment portion based on a compression state thereof.

* * * * *